United States Patent [19]

Hansen et al.

[11] Patent Number: 4,885,500

[45] Date of Patent: Dec. 5, 1989

[54] QUARTZ QUADRUPOLE FOR MASS FILTER

[75] Inventors: Stuart Hansen, Palo Alto; John Fjeldsted, Redwood City; Carolyn Broadbent, Los Altos, all of Calif.

[73] Assignee: Hewlett-Packard Company, Palo Alto, Calif.

[21] Appl. No.: 177,813

[22] Filed: Mar. 28, 1988

Related U.S. Application Data

[63] Continuation of Ser. No. 926,056, Nov. 19, 1986, abandoned.

[51] Int. Cl.[4] ..... H01J 1/88

[52] U.S. Cl. ..... 313/256; 250/281; 250/292; 250/293

[58] Field of Search ..... 313/256; 250/292, 293, 250/281

[56] References Cited

U.S. PATENT DOCUMENTS

| | | | |
|---|---|---|---|
| 3,757,115 | 9/1973 | Ball | 250/292 |
| 3,819,941 | 6/1974 | Carrico | 250/292 |
| 4,032,782 | 6/1977 | Smith et al. | 250/292 |
| 4,106,744 | 8/1978 | Lawrence, Jr. et al. | 250/292 |
| 4,117,321 | 9/1978 | Meyer | 250/292 |

FOREIGN PATENT DOCUMENTS

| | | | |
|---|---|---|---|
| 2737903 | 3/1979 | Fed. Rep. of Germany | 250/292 |
| 0091651 | 5/1984 | Japan | 250/292 |

OTHER PUBLICATIONS

"Materials and Techniques for Electron Tubes", by Kohl, General Telephon & Electronics, Technical Series 1960, TK 6565.V3.K65 C4, pp. 20–68.

*Primary Examiner*—Leo H. Boudreau
*Assistant Examiner*—Michael Razavi

[57] ABSTRACT

A quartz quadrupole comprises a quartz substrate, conductive strips and low-conductivity strips. The substrate includes hyperbolic inner surfaces which provide the geometry for the conformed conductive strips to produce an appropriate electric field for mass filter operation. The use of quartz as a substrate material provides the thermal and electrical characteristics required by high performance mass filtering operations, including scanning mode operation to 800 amu and above. During such operation, potential field distortions by accumulated charge in cusp sections of the substrate are minimized by the low-conductivity strips, which are arranged to overlap longitudinal edges of the conductive strips. Formation of the quartz substrate is made possible by high precision machining, grinding and polishing of a refractory metal mandrel. The actual step of forming the substrate is simplified by the low thermal coefficient of expansion of the quartz. The conductive strips are applied by firing metal-glass frit tape. The low-conductivity strips are applied by firing a metal-oxide slurry including a bonding agent.

3 Claims, 3 Drawing Sheets

QUARTZ QUADRUPOLE FOR MASS FILTER

CROSS REFERENCE TO RELATED APPLICATION

This application is a continuation of application Ser. No. 926,056, filed Nov. 19, 1986, now abandoned.

BACKGROUND OF THE INVENTION

The present invention relates to mass filters, including quadrupole mass filters, and, more particularly, to an electrode assembly, such as a quadrupole, for a mass filter.

Mass filters are tools for analyzing the chemical composition of matter, for example by using electric fields to separate ionized particles by their mass-to-charge ratios. High filtering resolution has been achieved using quadrupole mass filters that include four parallel elongated electrodes, the cross sections of which approximate hyperbolic arcs in respective quadrants about a common origin. Opposing pairs of electrodes are electrically connected.

A radio-frequency power amplifier (RFPA) is typically employed to drive both pairs of electrodes. One pair is driven with a selected radio frequency (RF) signal summed with a positive direct current (DC) potential The other pair of electrodes is driven by an RF signal 180° out of phase with that applied to the first pair, and is summed with a negative DC.

The RF field dominates the motion of relatively light ions, ejecting them from the functional center region of the quadrupole filter. The DC field dominates the relatively heavy ions, which are gradually attracted and absorbed by one of the electrodes of opposite conductivity. Ions of an appropriate intermediate weight can traverse a generally longitudinal trajectory through the quadrupole due to offsetting RF and DC effects.

Thus, by properly setting the RF and DC components of the field inside the quadrupole arrangement, any mass within the unit's operating range can be selected for detection and measurement. Thus a single setting can be used in a single ion measurement (SIM) mode. By contrast, in a scanning mode, the RF and DC components are swept in a properly coordinated fashion to yield the fragmentation spectrum of molecular species in a sample.

The theoretically ideal cross section for the four electrodes of a quadrupole mass filter is four hyperbolic curves extending in their respective quadrants to infinity. Generally, only the hyperbolic arcs near the origin are approximated. These arcs are typically implemented by grinding the desired shapes from solid metal, e.g. molybdenum or stainless steel, rods. The desired relative arrangement of the four ground rods is then maintained, for example, by harnesses of ceramic or other rigid, non-conductive material.

However, there are several disadvantages to this four rod implementation of a quadrupole filter, e.g., expense, weight, bulk, and vulnerability to misalignment. For example, grinding identical hyperbolic surfaces on four several-inch long molybdenum rods is costly both in terms of time and materials. Furthermore, only the hyperbolic surface is electrically useful. The bulk of the rods serves only limited functions such as providing rigidity. If the four rods in ceramic harnesses are jolted, misalignment can easily occur. Furthermore, this misalignment may be undetectable by an unaided eye, and yet unpredictably distort mass readings.

One approach to ameliorating some of these problems has been to encase quadrupole rods in a square tubular glass frame. The individual rods are conformed to the frame, which results in less mass and bulk. The glass frame also serves to maintain rigidity when forces are applied. However, it is not clear to what extent the minor theoretical advantages of this approach translate into practice. Furthermore, additional improvements in weight, size and reliability are still required. Finally, no significant cost savings is apparent in this approach.

A more dramatic alternative being considered is the use of glass quadrupoles. Such a quadrupole is disclosed in U.S. Pat. No. 3,328,146 to Hänlein. The structure of an electrode assembly is provided by an appropriately shaped glass tube which serves as a substrate for the quadrupole. The desired hyperbolic shapes of the electrodes can be achieved by conforming thin strips of metal to hyperbolic contours on the inner surface of a glass tube.

This approach provides greatly reduced size and weight due to the substitution of glass and thin strips of metal for the rods in the aforementioned approaches. Cost and labor is greatly reduced since glass can be economically obtained, and can be formed by vacuum formation over a mandrel. The costs and time involved in grinding metal rods is reduced to that required to form a reusable mandrel, as opposed to four quadrupoles per mass filter.

Glass tends to be less susceptible than quadrupole metals to small inelastic deformation, so that valid measurements are generally obtainable except when the structural integrity of the glass is breached. Damage to a glass quadrupole is more readily detected visually than damage to a metal quadrupole. Thus, there is less likelihood of a damaged glass quadrupole being operated under the impression that it is providing valid measurements.

While the conception of a glass quadrupole suggests some significant advantages, reduction to practice has taken a tortuous path. Whereas the metal quadrupole mass filter had the luxury of extended commercial development, the glass quadrupole is required to compete with a mature technology at the outset. The years of user feedback and resulting adjustments and tweakings are necessarily telescoped in the development of a glass quadrupole mass filter.

The glass quadrupole introduces new geometries as well as new materials. For example, while both metal and glass quadrupoles are to approximate a hyperbolic cross section with four curves asymptotically approaching conceptual x and y axes towards infinity, the approximations diverge from one another. In the case of the metal quadrupoles, the cross section comprises four isolated closed curves, one for each rod. In the glass quadrupole, the fundamental shape comprises truncated hyperbolas which are interconnected rather than isolated.

The ideal hyperbolic cross section is determined to provide a predetermined ideal electric field in a cylindrical region about an axis extending orthogonally through an origin defining the hyperbolas. Both the metal and glass quadrupole approximations differ from the ideal so as to introduce "non-idealities" in this region which are not easily susceptible to complete mathematical characterization. Through years of development, the non-idealities in the electric field introduced by the non-ideal characteristics of metal quadrupoles have been minimized through extensive experimentation.

It is necessary, then, to identify, accommodate, and/or compensate for the performance affecting peculiarities of the new materials and geometries introduced in connection with glass quadrupole mass filters. Thus, it is a primary objective of the present invention to provide a mass filter which provides the size, bulk and reliability advantages of such a filter, without sacrificing the performance of mature metal quadrupole mass filters. Concomitantly, it is an objective of the present invention to provide a method of manufacturing such a quartz quadrupole filter.

SUMMARY OF THE INVENTION

The quest for the present invention involved identification of performance-limiting phenomena, actual and potential, pertaining to glass quadrupole mass filters. Identified phenomena include both electrical and thermal effects.

Specifically, it was discovered that performance is impaired when a low mass selection is set after a high mass setting in some versions of glass quadrupole mass filters. Such filters can require several minutes before accurate low mass reading are possible. This is considered an electrical phenomenon, it being conjectured that charge accumulation induced during high mass settings interferes or masks readings at low mass settings.

This charge accumulation is less problematic in the context of mass filters which are limited to small mass ranges or to a single ion measurement (SIM) mode. However, in a high performance mass filter, including the capability to operate in scanning mode to 800 amu and above, field distortions induced by such charge accumulation must be prevented or its effects otherwise minimized.

Thermal effects include impaired measurements due to geometric distortions in an quadrupole induced by thermal expansion, and degradation of a glass substrate due to cumulative stresses during fabrication and operation of the quadrupole. The thermal effects can be related to electrical effects in that heat is generated as RF energy is lost in the glass, especially at high mass settings. Thus, it is determined that a glass quadrupole designed for high performance mass filters, e.g. with ranges to 800 amu and above, must cope with the challenges posed by these electrical and thermal effects.

In accordance with the present invention, an electrode assembly is provided with a quartz substrate with conductive strips disposed upon elongated concave sections of the substrate. A low-conductivity material, such as a metal oxide, can be applied between the conductive strips to minimize field distortions due to charge accumulation Quartz is herein defined as glass with at least about 90% silica. Exemplary quartzes include fused silica and titanium silicate of 93% silica and 7% titanium oxide. These materials are characterized by loss factors of less than 0.2%, thermal expansion of less than $10^{-6}$cm/cm/°C., and thermal stress resistance of greater than 100° C. This combination of values is well-suited for high performance mass filters operating to 800 amu and above.

Quartz is routinely avoided in applications requiring ultra-high precision formation of a complex shape. This avoidance is largely due to the difficulty of working the refractory materials needed to withstand the high temperatures required to form quartz. In less demanding applications, quartz has been formed using molybdenum mandrels which have been centerless ground to high precision. Tungsten wire is typically used when a very small center bore is required.

Tungsten and molybdenum are much less workable than the materials, such as stainless steel and nickel, available for forming softer glasses. In addition, and again because of the high temperatures required for quartz, thermal end effects are more pronounced, demanding a longer, and therefore more difficult to fabricate, mandrel. However, in accordance with the present invention, it has been established that a suitable mandrel of refractory metal can be machined, ground and polished so that its external dimensions precisely match the desired interior dimensions of a quartz substrate, with due allowance given to thermal expansion effects during formation. Thus, a quartz tube can be conformed to such a mandrel, and the conductive and low-conductivity strips applied.

The steps of forming the substrate, forming the conductive strips and forming the low-conductivity strips can be applied in any order. In an exemplary method, a substrate is vacuum conformed to a refractory metal mandrel. Then, a silver and glass frit tape is applied to the elongated concave inner surfaces of the substrate, and the assembly is fired to fuse the glass in the tape to the adjacent substrate surface. A metal-oxide slurry, preferably including a bonding agent, is applied to the inner surface sections between the conductive strips, preferably, so as to overlap the edges of the conductive strips. The assembly is fired once again to bond and solidify the low-conductivity material.

It is an advantage of the present invention that the favorable thermal characteristics permit greater tolerance in the selection and application of the conductive strips and accessory materials. High-temperature processes which could damage softer glasses can be applied without danger of degrading the substrate. While the low loss factors of quartzes minimizes the heat generated in operation, the excellent thermal properties ensure that the effects of any generated heat are minimized. Finally, field distortions due to charge accumulation, a result in part of the extended mass range made possible by the present invention, can be mitigated using the low-conductivity strips in the bridge sections between conductive strips.

Accordingly, a quartz quadrupole and method of making the same are presented. In addition to its advantages over other glass quadrupoles, the quartz quadrupole provides for the performance of metal quadrupole mass filters while being susceptible to reduced manufacturing costs. Specifically, the quartz quadrupole is less expensive than a conventional molybdenum quadrupole due to lower material costs and lower added labor costs. In addition, the resulting filter is lighter, smaller and more reliable than conventional quadrupole mass filters. The quartz quadrupole is less sensitive to handling and in this respect provides more predictable performance. The lowered sensitivity to handling allows more readily replacement, since quartz quads are more easily shipped and less susceptible to damage during shipment. Also, quartz quadrupoles do not require expensive external support such as ceramic rings. Further features and aspects of the present invention are apparent from the detailed description below in connection with the following figures.

DESCRIPTION OF THE PREFERRED EMBODIMENTS

Figure 1:
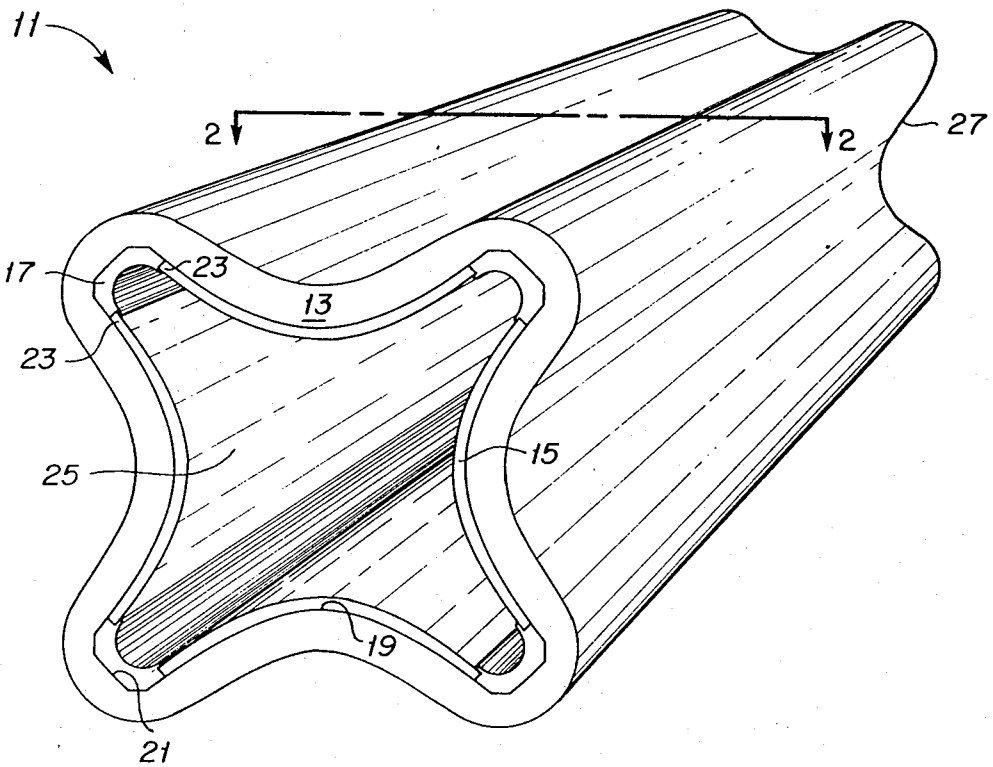
FIG. 1 is a perspective view of a quadrupole for a mass filter in accordance with the present invention.
Figure 2:
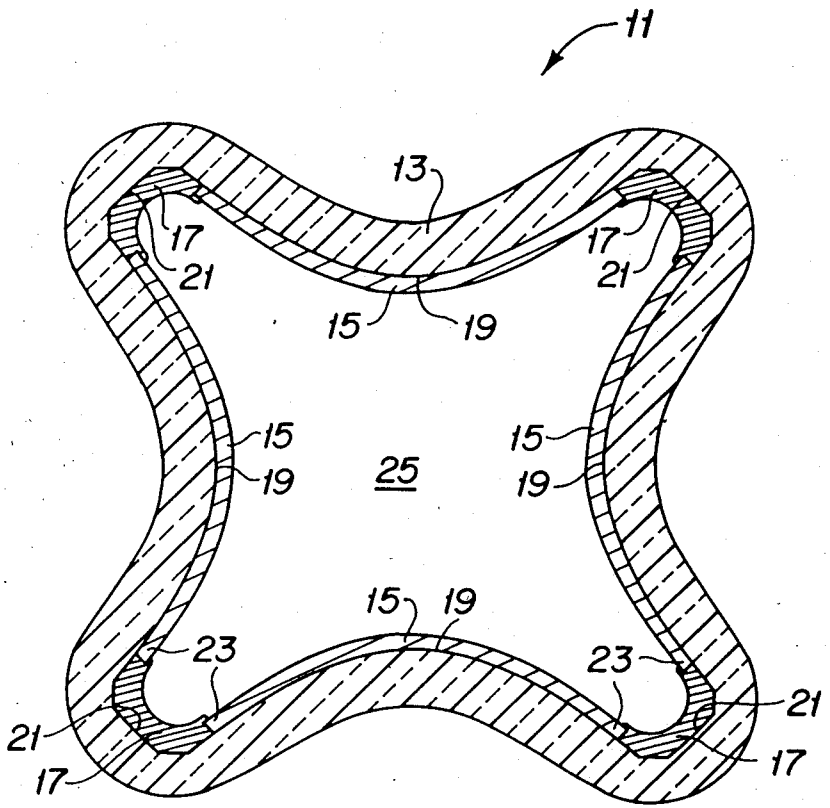
FIG. 2 is sectional view taken along line 2—2 of FIG. 1.

In accordance with the present invention, a quadrupole 11 (electrode assembly) for a mass filter includes a quartz substrate 13, four conductive strips 15 and four low-conductivity strips 17, as shown in FIGS. 1 and 2. The quartz substrate 13 provides the basic shape and structural rigidity to the quadrupole 11. The conductive strips 15 serve as the four electrodes via which electric fields are applied to the interior of quadrupole 11. The low-conductivity strips 17 are provided to minimize non-idealities in the desired electric field, induced, for example, by deviations from the ideal hyperbolic geometry at the inner surface of the quadrupole.

The conductive strips 15 are disposed along concave hyperbolic sections 19, while the low-conductivity strips 17 are disposed along intermediate cusps 21. Preferably, the low-conductivity strips 17 overlap adjacent longitudinally extending edges 23 of the conductive strips 15.

When the quadrupole 11 is incorporated into a complete quadrupole mass filter system, an ion source and an ion detector are located at opposite openings 25 and 27 of the quartz substrate 13. The conductive strips 15 can be connected to a RFPA and DC supplies in opposing pairs to form the oscillating electric fields which perform the filtering action on ions on generally axial trajectories through the interior of the quadrupole 11.

The material of the substrate is selected to minimize the thermal and electrical effects that impair performance, especially at mass settings of 800 amu and higher. The parameters of interest are loss factor, volume resistivity, thermal stress resistance, and thermal coefficient of expansion.

The loss factor is the product of the dielectric constant and the power factor (tangent of loss angle) for a material. The dielectric constant determines electric is the percentage of energy irrecoverably lost, in the form of heat, due to the motion of dipoles in an RF field. Generally, a higher percentage of energy is lost to heat as the temperature of the substrate is increased. Quadrupole mass filters typically operate at frequencies of 800 kHz to 4 MHz. Herein, loss factor values are given at 1 MHz and 20° C.

The significance of the loss factor in the context of the mass filter relates to thermal runaway in the substrate. Thermal runaway occurs when the amount of heat generated within the quartz exceeds the heat that can be radiated from the glass. The resulting increased glass temperature lowers the volume resistivity of the glass and increases the loss factor, requiring the RFPA to generate more power, which causes even greater heat generation. This positive feedback cycle characterizes thermal runaway, which ultimately requires more power than can be supplied.

The risk of thermal runaway increases at higher mass settings which require higher RF voltages. Thus, high performance mass filters require substrates with low loss factors. In accordance with the present invention, a substrate material is selected to have a loss factor less than 0.2%, and preferably less than 0.01%, at 1 MHz and 20° C.

Volume resistivity is a measure of the insulating quality of a glass. Volume resistivity largely governs the risk of dielectric failure at elevated temperatures. In other words, a glass of high volume resistivity is less likely to suffer a dielectric breakdown and unacceptably load the RFPA. Volume resistivity is specified herein in units of $\log_{10}$ of volume resistivity in ohm-cm. A volume resistivity of about 10 at 250° C. is appropriate for high performance applications.

Thermal stress resistance refers to capability of a glass to resist damage during heating and cooling. The values used herein refer to the maximum temperature to which a plate sample can be heated and then plunged into water at 10° C. without breaking.

While this scenario is not closely replicated within the environment of a mass filter, thermal stress resistance correlates sufficiently with other thermal variables of interest such as strain point, annealing point, softening point and working point, to serve as a general indicator of endurance under temperature-varying conditions. Generally, thermal stress resistance correlates with the hardness or viscosity of a glass. Furthermore, thermal stress resistance impacts the continued integrity of the substrate through processing steps such as firings used to secure the conductive and low-conductivity strips. For the performance objectives considered herein, a thermal stress resistance of at least 100° C., and preferably at least 200° C., is called for.

The thermal coefficient of expansion is a measure of the degree to which a material expands when heated. If the coefficient is negative, the material contracts when heated. This parameter affects substrate formability since the substrate must be conformed at elevated temperatures to a mandrel which changes dimensions in the process. This parameter is operationally important since dimensional changes impair mass axis stability and filter resolution. A higher expansion coefficient also means that a quadrupole which changes in temperature between tunings will experience more of change in diameter and consequently more of a mass assignment shift. For greatest simplicity and reliability in both formation and operation, the thermal coefficient of expansion should be as close to zero as possible. For the present performance objectives, the thermal coefficient of expansion should be less than $1\times10^{-6}$ *l cm/cm/°C.*

Having determined the ranges of values for loss factor, volume resistivity, thermal stress resistance and thermal coefficient of expansion required or preferred for a glass quadrupole to meet performance objectives, it is in accordance with the present invention to have the substrate formed of quartz, herein defined as glass having a silica content of at least 90%. Three exemplary quartzes are: a quartz with 96.5% silica, 3% borate and 0.5% alumina; fused silica, which is pure silica but for trace amounts of water (99.9% $SiO_2$,0.1% $H_2O$); and ultra-low-expansion titanium silicate, 93% silica, 7% $TiO_2$.

The 96.5% silica quartz has a loss factor of 0.15%, a volume resistivity of 9.7 ($\log_{10}$ ohm-cm), a thermal stress resistance of 220° C., and a thermal coefficient of expansion of $7.5\times10^{31\ 7}$ between 0° C. and 300° C. The corresponding values for fused silica are 0.0038%, 11.8 ($\log_{10}$ ohm-cm), 286° C., and $5.5\times10^{-7}$. The ultra-low-expansion titanium silicate has the following corresponding values: 0.008%, 12.2 ($\log_{10}$ ohm-cm), 3370° C., and $0.5\times10^{-7}$. Thus, all three of these quartzes fall within the high-performance parameters determined by the present invention.

the conductive strips 15 are disposed upon the substrate 13 in parallel. Each strip has parallel longitudinally extending edges 23. Each pair of adjacent conductive strips defines a gap which electrically and physically separates the same conductive strips. The conductive strips are thick enough to ensure electrical continuity. The thickness of the conductive strips is uniform to ensure that the hyperbolic shape of the underlying substrate sections is matched by the inner surfaces of the conductive strips. The illustrated conductive strips 15 are about 0.5 mil thick.

The conductive strips include a conductive material such as silver. Other constituents of the strip can include bonding agents. In the present embodiment, the conductive strip includes glass, some of which is fused to the underlying quartz of the substrate.

The low-conductivity strips 17 are applied to ameliorate field distortions that are especially prone to occur at the higher mass settings available in high performance mass filters. With respect to some of glass quadrupole mass filters, it has been found that performance can be impaired when a low mass selection is set after a high mass setting. An uncharged quad would perform well at low mass. However, the signal at low mass settings would disappear after even a brief high mass setting. Complete recovery took several minutes.

By way of explanation, and not of limitation, it is believed that the invalid low mass readings are the result of charge accumulation at the cusps 21 between adjacent pairs of conductive strips 15. The charge accumulation is greatest at high mass settings since the fields are strongest at such settings. The distortions are greatest at low mass settings, since the relative strengths of the selecting fields is less. In other words, the distorting fields are a greater percentage of the fields used for mass selection at low settings than the fields used at high mass settings. Thus, particularly at low mass settings, the accumulated charge acts to distort the central electric field and inhibit ion passage.

The inclusion of the low-conductivity strips 17 apparently retards the formation of accumulating charge, or facilitates dissipation of accumulated charge, or both. The exact mechanisms have not as yet been characterized. However, empirically, the low-conductivity strips 17 contribute to a practical quadrupole quartz filter by enhancing the ideality and repeatability of the electric fields within the substrate 13.

The low-conductivity strips 17 extend between adjacent conductive strips 15. In the illustrated embodiment, each low-conductivity strip 17 overlaps the adjacent longitudinal edges 23 of the adjacent conductive strips 15. With the low-conductivity strips incorporated as shown, negligible recovery time is required for valid low mass settings following high mass settings.

In addition to minimizing electrical field distortions within the quadrupole, the low-conductivity strips should be thermally stable over the expected operating temperature range of the quadrupole. Further, the low-conductivity strips should be dimensionally compatible with the thermal expansion profile of the substrate over the operating temperature range of the quadrupole. As with the substrate, the low-conductivity strips should have a low loss factor.

Accordingly, a suitable material for the low-conductivity strips can include a metal oxide. Zirconium oxide is particularly effective, but chromium oxide is an alternative. These materials can be applied as described below by firing a metal oxide bearing slurry. The low-conductivity strips can also advantageously include a bonding agent such as potassium silicate to secure adherence to the substrate.

There are three basic steps to manufacturing a quartz quadrupole such as that described above: forming the quartz substrate, applying the conductive strips, and applying the low-conductivity strips. The present invention provides for considerable variation in the sequencing and detailing of these steps. In addition, mandrel formation can be considered a preliminary step.

Figure 3:
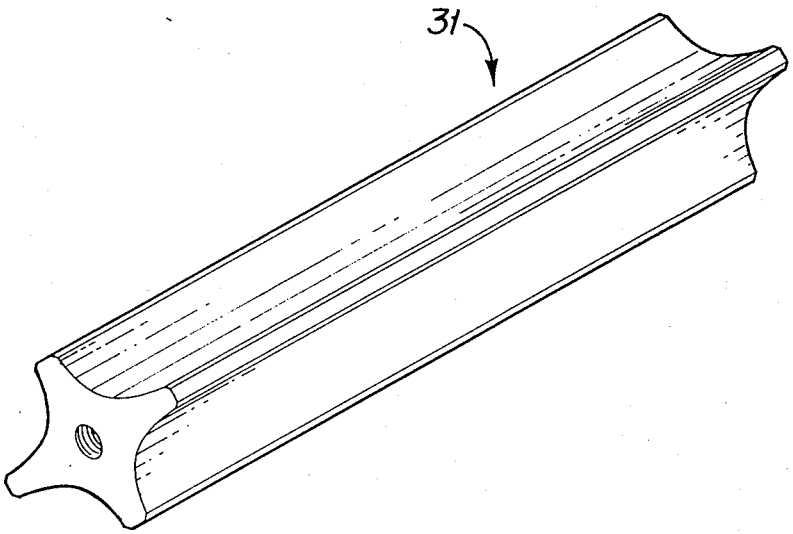
FIG 3 is a perspective view of a mandrel used in a method of manufacturing a quadrupole in accordance with the present invention.

In order to economically form quartz substrates of the desired shape, a mandrel that can maintain its integrity through repeated exposures to the elevated temperatures used to form quartzes is required. Mandrels of refractory metal, such as molybdenum, tungsten, and an alloy of hafnium, carbon and molybdenum (HCM) can be used. In accordance with the present invention, it has been determined that such materials can in fact be machined, ground and polished with the required precision to the appropriate shape and dimensions required to form a suitable mandrel 31, shown in FIG. 3.

The mandrel 31 is dimensioned so that its external dimensions correspond to the internal dimensions of the substrate at formation temperatures. Since the metals have greater thermal coefficients of expansion than quartzes, the mandrel must be relatively smaller than the interior of the desired substrate at room temperature.

In a preferred method, after the mandrel is formed and the substrate conformed, the conductive strips are formed followed by the low-conductivity strips. A quartz tube, of circular cross section and appropriate diameter and thickness, is blown closed at one end. An accurately machined, ground and polished mandrel is inserted axially into the tube. The second end of the quartz tube is connected to a vacuum pump. The quartz, when sufficiently heated, is pushed by atmospheric pressure tightly onto the mandrel.

Once the quartz conforms to the mandrel, the quartz and mandrel are allowed to cool. During this phase, the mandrel contracts more strongly than the substrate, so that, the mandrel can be easily removed. The properly formed quartz tube can be trimmed to a desired length, 8" in the illustrated embodiment. The ends can be ground or otherwise smoothed. This process yields the substrate 13 with the cross section illustrated in FIG. 2.

With the substrate 13 so formed, strips of silver-glass frit tape are applied to each of the interior hyperbolic surface sections 19. The tape can then be fired to fuse the glass in the tape to the adjacent hyperbolic surfaces of the substrate. The strips of tape are arranged in parallel, with parallel gaps between adjacent edges 23 of adjacent pairs of conductive strips 15.

The conductive strips in the illustrated embodiment are deposited by means of a metallization tape. The tape provides for accurate positioning and uniform thickness for the conductive strip. The metallization tape includes four layers, a cellophane or other carrier layer, a silver or other coating layer, an adhesive layer and a paper protective layer.

In order to apply the tape, the paper layer is removed to expose the adhesive. The tape is then positioned with respect to the substrate. The tape is then smoothly pressed onto the substrate to which the adhesive sticks. After all four conductive strips are positioned, the cellophane layers are removed, and the assembly is fired at a temperature sufficient for permanent adhesion of the tape.

The tape can be applied to wrap over the ends of the substrate to facilitate connections to RFPA contact strips. In this case, additional sets of conductive strips can be applied to the exterior of the substrate following the procedures applied to the interior strips.

The conductive strips can be applied in a variety of alternative ways. For example, the cusps or bridge sections of the substrate can be masked, and the substrate dipped in a silvering solution so that the unmasked hyperbolic sections are "mirrored".

The next step in the preferred method is to apply low-conductivity strips along the gaps between the conductive strips. The low-conductive strips can be formed from a metal-oxide slurry, preferably containing a bonding agent. Accordingly, a slurry can be formed by mixing zirconium oxide with a solution of potassium silicate in water. An alternative to the preferred zirconium slurry, is a chromium oxide slurry such as DAG, sometimes used for minimizing charge accumulations in cathode ray tubes.

This slurry can be pumped through a brush or flattened nozzle which is concurrently drawn over the length of the gap to which the low-conductivity strip is to be applied. Preferably, the slurry is applied so as to overlap the adjacent longitudinal edges of the adjacent conductive strips to inhibit charge emissions during high mass settings of an incorporating mass filter. The slurry is allowed to air dry and then is fired until the strip is solidified and adhered to the substrate.

The resulting assembly readily lends itself to the attachment of connecting pads for the radio frequency power amplifier. The same conductive tape used to form the electrodes can be used to create conductive paths from each electrode to points on the outer surfaces of the tube. Opposing electrodes can then be electrically connected by joining corresponds pads with additional strips of the conductive tape. Preferably, each application of conductive is fired separately to ensure proper bonding of each layer to the quartz tube and underlying conductive layers.

This method of providing connections to the RFPA has several advantages to alternative approaches, which often involves penetrating the substrate with screws or bolts. The tape is generally less expensive, and readily available since it is already used on the interior. Thus, component stockpiling is simplified. The RFPA connections are clearly out of the way of the electric field, being shielded by the inner conductive strips. Yet, these connecting strips add very little bulk and weight to the assembly Finally, the tape is much less likely than screws or other alternatives to damage the substrate during application. While this method of providing connections could be extended to alternative quadrupoles, an advantage of the present invention is that it provides for these connections using materials already involved in making the quadrupole itself.

Another advantage of the present invention is that the high transformation temperatures of quartzes ensure that the substrate maintains its exact shape during processes of firing the slurry and the inner and outer strips of tape. These firings can occur at temperatures far below the transformation temperatures of the preferred quartzes. Alternatively, the quartz substrates can comfortably tolerate a wide range of processing steps involving elevated temperatures.

In addition to the sequence detailed above, the invention provides for many alternatives. It is quite feasible to apply the low-conductivity strips prior to the conductive strips. It is further provided that the conductive strips and low-conductivity strips be applied concurrently, or in alternation with co-firing.

In another method provided by the present invention, the strips of conductive material and low-conductivity material are applied during the conforming of the quartz tube to the mandrel. This can be accomplished by applying appropriate materials and carriers on the mandrel itself so that upon conformance of the quartz to the mandrel or upon cooling, the materials adhere to the quartz rather than the mandrel. This approach can be used with both or either of the conductive and low-conductivity materials. In the case one material is applied during substrate formation, the other can be applied later.

Another alternative is to apply one or both of the conductive and low-conductivity materials prior to shaping of the substrate. For example, conductive strips can be applied to the quartz substrate while in cylindrical form prior to conformance to the mandrel. This has the advantage that the surfaces of the electrodes are conformed to the hyperbolic mandrel directly, rather than indirectly.

Thus, in accordance with the foregoing, an improved quadrupole combining the advantages of other glass and metal quadrupoles is presented. This quartz quadrupole can be fabricated, as detailed above, to create a high performance mass filter, capable of scanning masses to 800 amu and above. As is apparent to those skilled in the art, many variations and modification of the embodiments presented are suggested. Accordingly, the scope of the present invention is limited only by the following claims.

What is claimed is:

1. A quadrupole mass filter electrode assembly comprising:

a glass tube having four elongated concave sections with inner surfaces having generally hyperbolic cross sections, said concave sections being arranged in parallel opposing pairs, and bridge sections with bridging inner surfaces connecting adjacent pairs of concave sections;

parallel conductive strips, each disposed longitudinally upon a respective one of said hyperbolic inner surfaces; and low-conductivity strips, each disposed upon a respective of said bridging inner surfaces, said low-conductivity strips including metal oxide and a bonding agent for adhering said metal oxide to said respective bridging inner surfaces.

2. A quadrupole mass filter electrode assembly comprising:

a glass tube having four elongated concave sections with inner surfaces having generally hyperbolic cross sections, said concave sections being arranged in parallel opposing pairs, and bridge sections with bridging inner surfaces connecting adjacent pairs of concave sections;

parallel conductive strips, each disposed longitudinally upon a respective one of said hyperbolic inner surfaces; and low-conductivity strips, each disposed upon a respective of said bridging inner surfaces, said low-conductivity strips consisting at least in part of zirconium oxide.

3. A method of manufacturing an electrode assembly for a mass filter, said method comprising the steps of:

forming an elongated quartz tube having plural concave longitudinal sections, adjacent pairs of which are connected by bridging sections;

forming conductive strips upon the inner surface of said tube, locating each of said conductive strips adjacent a respective one of said concave sections so that each of said conductive strips is separated from adjacent ones of said conductive strips, each of said conductive strips being formed by applying a respective strip of tape including a mixture of metal and glass to respective ones of said concave longitudinal sections and heating said tape until at least some of said glass fuses to the respective of said concave longitudinal sections; and forming low-conductive strips upon the inner surface of said tube, locating each of said low-conductivity strips adjacent a respective one of said bridging sections, said low-conductivity strips being formed by applying to said inner surface a slurry consisting of zirconium oxide, a bonding agent and water, said slurry being heated so that it solidifies and bonds to said inner surface.

* * * * *